US011203906B2

(12) United States Patent
Roodenburg et al.

(10) Patent No.: US 11,203,906 B2
(45) Date of Patent: Dec. 21, 2021

(54) VESSEL AND METHOD TO PERFORM SUBSEA WELLBORE RELATED OPERATIONS

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 163 days.

(21) Appl. No.: 16/624,169

(22) PCT Filed: Jul. 10, 2018

(86) PCT No.: PCT/NL2018/050454
§ 371 (c)(1),
(2) Date: Dec. 18, 2019

(87) PCT Pub. No.: WO2019/013619
PCT Pub. Date: Jan. 17, 2019

(65) Prior Publication Data

US 2020/0141192 A1 May 7, 2020

(30) Foreign Application Priority Data

Jul. 11, 2017 (NL) ..... 2019225

(51) Int. Cl.
*E21B 19/02* (2006.01)
*B63B 3/14* (2006.01)
(Continued)

(52) U.S. Cl.
CPC ..... *E21B 19/02* (2013.01); *B63B 3/14* (2013.01); *E21B 15/003* (2013.01); *E21B 15/02* (2013.01); *B63B 2003/147* (2013.01)

(58) Field of Classification Search
CPC ..... E21B 19/02; E21B 15/003; E21B 15/02; B63B 3/14; B63B 2003/147
(Continued)

(56) References Cited

U.S. PATENT DOCUMENTS 4,351,398 A * 9/1982 Prins ..... E21B 3/04 173/104
6,763,898 B1 * 7/2004 Roodenburg ..... E21B 15/00 166/358
(Continued)

FOREIGN PATENT DOCUMENTS

WO WO 99/11901 A1 3/1999
WO WO 2004/020275 A2 3/2004
(Continued)

OTHER PUBLICATIONS

International Search Report, issued in PCT/NL2018/050454, dated Sep. 13, 2018.
(Continued)

*Primary Examiner* — Matthew R Buck
*Assistant Examiner* — Patrick F Lambe
(74) *Attorney, Agent, or Firm* — Birch, Stewart, Kolasch & Birch, LLP

(57) ABSTRACT

A vessel and method to perform subsea wellbore related operations, e.g. slim hole technique drilling of a subsea wellbore are disclosed. The vessel has a hull with at least one moonpool defining first and second moonpool areas. A vertical tower is mounted on a tower supporting hull structure and has a vertical operative face. A hoisting device has a winch and winch driven cable, and is adapted to suspend a load from said vertical tower via said at least one winch driven cable and to manipulate the suspended load in a firing line of the tower that extends along and outside of said vertical operative face of the tower. The tower is slewable
(Continued)

about a vertical slew axis by means of a slewing drive at least into first and second operative positions wherein the firing line extends through the first and second moonpool areas respectively.

21 Claims, 4 Drawing Sheets

(51) Int. Cl.
*E21B 15/00* (2006.01)
*E21B 15/02* (2006.01)

(58) Field of Classification Search
USPC ..... 166/385
See application file for complete search history.

(56) References Cited

U.S. PATENT DOCUMENTS

2002/0166698 A1* 11/2002 Beato ..... E21B 19/006
175/7
2015/0217838 A1* 8/2015 Antonsen ..... B63B 27/08
414/803
2017/0226810 A1* 8/2017 Lutcherath ..... E21B 19/146
2018/0216405 A1* 8/2018 De Mul ..... E21B 19/06

FOREIGN PATENT DOCUMENTS

WO WO 2009/102196 A2 8/2009
WO WO 2015/166514 A1 11/2015

OTHER PUBLICATIONS

Written Opinion of the International Searching Authority, issued in PCT/NL2018/050454, dated Sep. 13, 2018.

* cited by examiner

VESSEL AND METHOD TO PERFORM SUBSEA WELLBORE RELATED OPERATIONS

FIELD OF THE INVENTION

The present invention also relates to a vessel and a method to perform subsea wellbore related operations, e.g. drilling, and/or wellbore intervention operations, and/or installation of wellbore related subsea equipment. For example, the invention is considered advantageous when using the slim hole technique for drilling of a subsea wellbore, e.g. in an exploratory drilling project.

BACKGROUND OF THE INVENTION

WO2004/020275 discloses, for example in FIG. 3 thereof, a vessel adapted to perform subsea wellbore related operations, e.g. wellbore intervention operations, and/or installation of wellbore related subsea equipment. This known vessel has a monohull type floating hull with a single moonpool that extends down from a deck of the vessel and which defines a single moonpool opening to a lower opening thereof in the bottom of the hull. This moonpool is in said FIG. 3 aft of a vertical tower of the vessel that is mounted stationary on a tower supporting hull structure of the hull, directly adjacent a front edge of the moonpool. The vertical tower is configured to perform subsea wellbore related operations and has a single vertical operative face that is directed towards the moonpool. On this operative face a pair of vertical guide rails is mounted and a travelling device, here a trolley, is provided that is movable up and down along and outside of this operative side of the tower and guided by these vertical guide rails of the tower. The tower is provided with a winch and a winch driven cable, which passes from a crown block with one or more cable sheaves at the top of the tower down along a firing line of the tower. In an embodiment the travelling device mostly serves to guide this cable and a load in the firing line, e.g. mating with a load connector as a load is lifted out of the water. In another embodiment the travelling device is suspended from the winch driven cable and the travelling device is adapted to suspend a load from the travelling device. In each case the hoisting device which comprises the winch and winch driven cable is adapted to suspend a load from the vertical tower via the winch driven cable and to manipulate the suspended load the firing line of the tower that extends along and outside of said vertical operative face of the tower.

U.S. Pat. No. 6,763,898 discloses a vessel which has a monohull type floating hull with a single elongated moonpool and with a tower supporting hull structure that extends substantially in transverse direction of the hull as a bridge above the waterline in the moonpool. Fore and aft of this transverse hull structure there are first and second moonpool openings in the deck respectively, which are thus offset from one another in the direction of the longitudinal axis of the hull. A vertical tower of the vessel is mounted stationary on this transverse tower supporting hull structure. The vertical tower is configured to perform subsea wellbore related operations and has fore and aft operative vertical sides, each of said sides being directed towards the associated moonpool opening. On each of these operative faces there is a pair of vertical guide rails and a travelling device or trolley is provided that is movable up and down along and outside of the operative side of the tower and guided by these vertical guide rails of the tower. There are two hoisting devices provided, each associated with a respective operative side of the tower. A first winch and first winch driven cable are associated with the first moonpool opening. The first winch driven cable passes from a forward arranged crown block with one or more cable sheaves at the top of the tower down along a first firing line of the tower. Similarly, a second winch and second winch driven cable are associated with the second moonpool opening. The second winch driven cable passes from a rearward arranged crown block with one or more cable sheaves at the top of the tower down along a second firing line of the tower. In all, this known vessel is capable of manipulating suspended loads in each of the two firing lines of the tower, wherein each firing line extends along and outside of a respective vertical operative face of the tower and wherein there is a dedicated hoisting device for each operative side of the tower.

WO99/11901 discloses a vessel with a moonpool having a moonpool opening. The vessel is provided with a main tower and an auxiliary tower, preferably these towers being connected by a bracing. The towers are arranged along a side of the moonpool opening. In the moonpool a clamp carriage is arranged that is movable between a first position aligned with the firing line of the main tower and a second position aligned with the firing line of the auxiliary tower. Each tower has an operative side facing the moonpool and is provided with vertical guide rails for a respective travelling device. Each tower is provided with its own hoisting device.

OBJECT OF THE INVENTION

The present invention aims to provide a vessel that offers versatility at an economically attractive investment and operational costs.

SUMMARY OF THE INVENTION

This aim is achieved by provision of a vessel, which vessel is characterized in that the at least one moonpool of the vessel is embodied to further define a second moonpool area that is offset from said first moonpool area, and in that the vertical tower is connected to the tower supporting hull structure via one or more slew bearings and the vessel is provided with a slewing drive, such that the vertical tower is slewable about a vertical slew axis by means of said slewing drive at least into a first operative position wherein the firing line of the tower extends through the first moonpool area and into a second operative position wherein the firing line of the tower extends through the second moonpool area.

The inventive vessel, in particular the tower, hoisting device, and slewing arrangement of the tower offers the possibility to manipulate a load by means of the hoisting device associated with the operative face of the tower in either moonpool along the appropriately positioned firing line, yet not simultaneously as in the vessels of U.S. Pat. No. 6,763,898 and WO99/11901.

The inventive vessel is, for example, attractive in the course of slim hole technique drilling operations wherein, due to the slim design of the components involved, the hoisting capacity of the tower and of the hoisting device is relatively low compared to more traditional subsea drilling. For example, the hoisting capacity can be between 200 and 400 tons.

For example, it is envisaged that exploratory drilling projects are more economical with the slim hole technique performed using the inventive vessel, than with the more complex and costly dual firing lines vessel design as shown in US U.S. Pat. No. 6,763,898. As the hoisting capacity of the tower may be relatively low, the provision of a slewing arrangement for the tower is practical and economically affordable.

In an embodiment the first and second operative positions of the tower are diametrically opposite the slew axis, so for example a slew motion of 180 degrees is required to move the tower between its first and second operative positions. It will be appreciated that other arrangements of the first and second operative positions may also be possible, e.g. the angular displacement being less than 180 degrees between the two operative positions.

It will be appreciated that it is not necessary for the tower to be slewable over a full revolution or even more. For example, a 180 degrees slewing range would be sufficient for the example elucidated herein with reference to the drawings. A slewing range of less than a full revolution, e.g. of about 180 degrees, may for example be beneficial in view the equipment need for providing electrical power, etc. to the tower.

In an embodiment the tower supporting hull structure extends in between the first and second moonpool areas, so for example with the first and second moonpool areas being offset in longitudinal direction on a monohull type vessel and with the hull structure extending transverse between the moonpool areas.

In an embodiment the hull is a monohull having a longitudinal axis, wherein the first and second moonpool areas are offset from one another in the direction of the longitudinal axis. Preferably the tower supporting hull structure extends substantially in a transverse direction of the hull and in between the first and second moonpool areas. For example, the first moonpool area is fore, so forward, of the vertical tower and the second moonpool area is aft, so rearward, of the tower.

In an embodiment the vessel has a deck, e.g. a deck rearward from a bridge and crew superstructure on the bow of the vessel, wherein the first and second moonpool areas are defined by offset first and second moonpool openings in the deck.

In an embodiment the vessel has distinct first and second moonpools, each extending between a respective first and second moonpool opening in a deck of the vessel to a respective lower opening in the bottom of the hull, e.g. said lower opening below the design waterline of the vessel.

It will be appreciated that, whilst implementation of the invention in a monohull type vessel is seen as advantageous in view of costs, the vessel can also be for example a semi-submersible vessel wherein the at least one moonpool is provided in a deckbox structure of the vessel, so with the lower opening(s) above the waterline.

In an embodiment the vessel has a single moonpool with the tower supporting hull structure being embodied as a bridge over a central area of the moonpool, e.g. as shown in U.S. Pat. No. 6,763,989. This bridge is then preferably above the design waterline of the vessel, e.g. allowing for a cart on rails to be arranged within the moonpool, above waterline, the cart being displaceable between for example a position aligned with the first firing line and a position aligned with the second firing line. In the design with a bridge part of the hull the first and second moonpool areas are located an opposite sides of the tower supporting hull structure and each defined by a respective first and second moonpool opening in a deck of the vessel.

In an embodiment the tower has a foot and at least one slew bearing is arranged between said foot of the tower and the tower supporting hull structure. In another arrangement one can envisage a design resembling a kingpost crane, with a stationary vertical column that is fixed at its lower end to the tower supporting hull structure and with a revolving tower that is supported on said column, e.g. via an upper slew bearing on an upper portion of the column and with a lower slew bearing on a lower portion of the column.

It is noted that slew bearing can have many different designs, for example as roller bearing with one or more tracks and sets of rollers in between. A low friction slide bearing can also be envisaged or combined with one or more roller tracks, e.g. in an embodiment wherein one or more roller sets absorb mainly a vertical load and momentum on the tower and with a slide bearing absorbing radial forces. The slew bearing may also involve a hydrostatic arrangement wherein lubricant is forcefully fed in between bearing surfaces. The slew bearing may also involve the use of a skid arrangement, e.g. with a circular or semi-circular skid rail structure on which the tower is placed and skidded by a skid drive to perform the slew motion between the mentioned operative positions.

In an embodiment the tower is provided at the operative side with one or more vertical guide rails and a travelling device, e.g. a trolley, is provided that is movable up and down along and outside of the operative side of the tower and guided by the one or more vertical guide rails of the tower. The travelling device can for example be a trolley. The travelling device may comprise one or more sets of guide rollers engaging the one or more guide rails. For example, the travelling device is suspended from the winch driven cable and the travelling device is adapted to suspend a load from said travelling device.

In an embodiment the hull of the vessel is provided, at least for one moonpool area, with one or more hull mounted vertical guide rails which are arranged such that in the first and/or in the second operative position of the tower the one or more guide rails of the tower align with the one or more hull mounted vertical guide rails. For example, the one or more hull mounted guide rails extend to a lower opening in a bottom of the hull. This arrangement allows for the functionality described in WO2004/020275, e.g. in view of guiding an object that is passed through the splash zone in the moonpool when lowering or lifting the object by means of the hoisting device of the tower.

In an embodiment the tower is embodied as a mast having a closed wall contour, e.g. over at least a major portion of the height of the tower, for example over a lower major portion with a top portion being embodied as a latticed structure or over the entire height of the tower.

In another embodiment the tower is embodied as a mast having a latticed structure, e.g. over at least a major portion of the height of the tower, e.g. over the entire height of the tower. For example, the operative side facing the firing line is cladded with a panel so as to avoid any entanglement of components and/or loads in the latticed structure during manipulation activities with the hoisting device.

In an embodiment the winch of the hoisting device is mounted on the tower, e.g. inside the closed wall contour or on a side of the tower, e.g. on a side opposite the operative side and to the outside thereof. In the latter design the weight of the one or more winches may be employed as a counterweight for the load in the firing line of the tower, e.g. thus reducing loads on the slew bearing. In another design the winch is mounted in the hull, e.g. in the tower supporting structure.

In an embodiment the tower is provided with one or more heave compensation cylinders acting on one or more cable sheaves along with the winch driven cable passes in order to provide heave compensation functionality. In another arrangement and/or in combination therewith the winch may be an AHC winch, that is an active heave compensation winch.

In an embodiment the vessel is provided with a top drive device as commonly used in drilling operations. For example, the top drive device is connected or connectable to the travelling device on the tower. The top drive device comprises one or more motors to provide torque to a rotary output quill that is connectable to a drilling tubulars string as is known in the art.

In an embodiment at least one of the first and second moonpool areas is defined by a moonpool opening in a deck of the vessel. Herein the vessel is provided with one or more movable, e.g. horizontally slidable, hatches associated with each moonpool opening. The one or more hatches in an opened position thereof clear the moonpool opening and in a closed position thereof form a hatch cover over the moonpool opening. This for example may allow for the one or more hatches to be embodied as a drill floor.

In an embodiment the one or more hatches associated with at least one of the first and second moonpool opening are provided with a pair of skid rails, and the deck in a region adjacent the moonpool opening is provided with a pair of deck mounted skid rails. Herein, in the closed position of the one or more hatches, the pair of skid rails provided on the one or more hatches align with the pair of deck mounted skid rails in order to allow skidding of an object, e.g. a coiled tubing injector device, onto and off the one or more closed position hatches. The one or more hatches may define an opening therein, e.g. to be aligned with the firing line in the closed position of the one or more hatches, to allow passage of a tubulars string, coiled tubing, etc., through the closed hatch(es) along the firing line.

In an embodiment the vessel is provided with a coiled tubing injector device. For example, the coiled tubing injector device is adapted for skidding onto and off the closed position hatches, e.g. in order to align the CT device with the firing line. In another embodiment the vessel comprises a riser tensioner frame that is suspendable from the hoisting device, e.g. provided with heave compensation functionality, with the riser tensioner frame being adapted to receive therein, or being equipped with, at least a coiled tubing injector device and/or a wireline device, e.g. with one or more associated pressure control devices.

In embodiments it is envisaged that a (composite) coiled tubing drill string is used to perform drilling activities using the inventive vessel.

In an embodiment the vessel has a deck adjacent at least one of the first and second moonpool areas and a pair of skid rails are provided on which a skiddable coiled tubing reel is placed on to be placed. This allows for skidding said reel between a remote storage position and an operative position.

In an embodiment the vessel has deck adjacent one of the first and the second moonpool area and a catwalk machine is arranged on said deck allowing to feed and remove drilling tubulars to and from the firing line when the tower is in the operative position thereof associated with said moonpool area. This e.g. allows for the deployment of a drilling pipe string, a casing string, etc.

In an embodiment the one or more hatches associated with a moonpool opening are configured as a drill floor, e.g. having a well center opening therein through which a drill string passes along the firing line.

In an embodiment the vessel is provided with a storage reel storing or configured to store thereon a spoolable subsea riser or a coiled tubing guide hose, e.g. a composite spoolable subsea riser or coiled tubing guide hose as may be used in a slim hole drilling technique.

In an embodiment the vessel is provided with a coiled tubing guide hose tensioner device having multiple tracks, e.g. in a substantially vertical arrangement, which tensioner device is configured to be arranged in an operative position thereof near, e.g. above, the first or said second moonpool area and to support the length of coiled tubing guide hose extending to subsea equipment mounted on a subsea well head.

In an embodiment the coiled tubing guide hose tensioner device is configured to be skidded onto and off said one or more hatches onto which said pair of skid rails is provided.

In an embodiment the vessel is provided with a driller's cabin having windows offering view on both the first moonpool area and the second moonpool area.

The present invention also relates to a vessel which has a hull with at least one moonpool defining first and second moonpool areas. A vertical tower is mounted on a tower supporting hull structure and has a vertical operative face. A hoisting device has a winch and winch driven cable, and is adapted to suspend a load from said vertical tower via said at least one winch driven cable and to manipulate said suspended load in a firing line of the tower that extends along and outside of said vertical operative face of the tower. The tower is slewable about a vertical slew axis by means of said slewing drive at least into first and second operative positions wherein the firing line extends through the first and second moonpool areas respectively.

The present invention also relates to a vessel and a method to perform subsea wellbore related operations, e.g. slim hole technique drilling of a subsea wellbore, as described herein.

The invention will now be discussed with reference to the appended drawings.

DETAILED DESCRIPTION OF EMBODIMENTS

Figure 1:
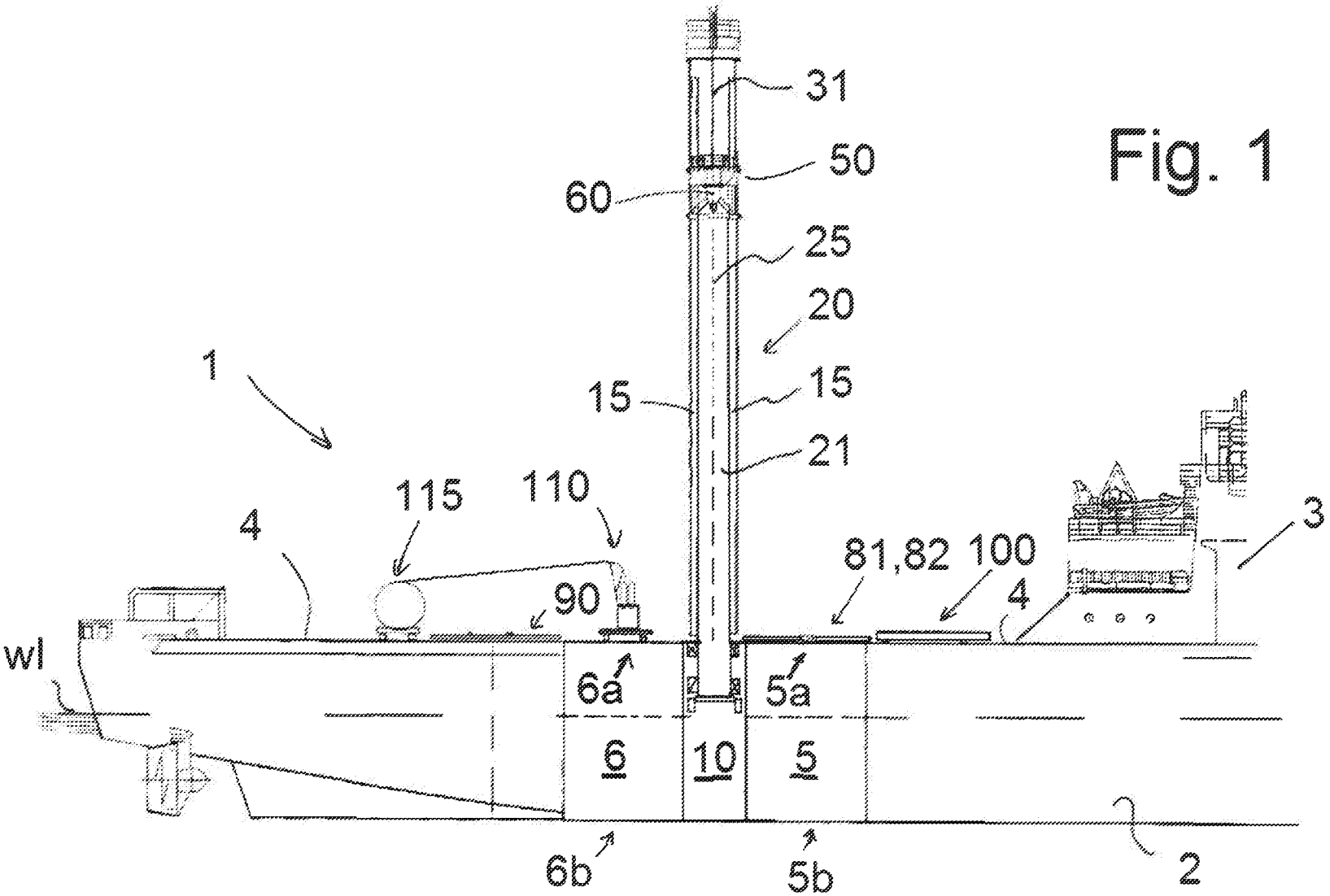
FIG. 1 shows schematically an example of a vessel to perform subsea wellbore related operations according to the invention.

With reference to FIGS. 1-4 an example of a vessel 1 adapted to perform subsea wellbore related operations will be discussed. The vessel 1 may, for example, be employed for drilling, and/or wellbore intervention operations, and/or installation of wellbore related subsea equipment.

For example, the vessel 1 is considered advantageous for use with the slim hole technique drilling of a subsea wellbore. This slim hole technique is, for example and non-limiting, often defined as using equipment to drill a well that has a diameter over most, e.g. 90%, of its length of 7 inches or less. It is envisaged that this technique may be beneficial for effective exploratory drilling projects, wherein at a later stage a larger diameter actual production well can be drilled with traditional drilling equipment from a much larger drilling vessel, e.g. a vessel as in U.S. Pat. No. 6,763,898.

The vessel here is, as preferred, a monohull type vessel with a hull 2 having a bow and a stern. A bridge and crew accommodation superstructure 3 is arranged on the bow. Aft of the superstructure a deck 4 extends, here all the way to the stern of the vessel.

The vessels hull here is provided with two moonpools 5, 6; a front or fore moonpool 5 and a rear or aft moonpool 6. These moonpools 5, 6 each extend from a respective moonpool opening 5*a*, 6*a* in the deck 4 to a lower opening 5*b*, 6*b* in the bottom of the hull. The design waterline WL is shown in the FIG. 1.

The moonpools 5, 6 are offset from one another in the direction of the longitudinal axis of the vessels hull 2.

The first moonpool 5 thus defines first moonpool area, that is also denoted here with reference numeral 5. The second moonpool 6 thus defines second moonpool area, that is also denoted here with reference numeral 6.

The hull 2 comprises a tower supporting hull structure 10. This structure 10 extends in between the first and second moonpools 5, 6, here from deck 4 to the level of the bottom of the hull so that the moonpools 5, 6 are completely separated.

A vertical tower 20, here embodied as a closed contoured mast, is provided and is configured to perform subsea wellbore related operations.

The vertical tower 20 is mounted on the tower supporting hull structure 10, so generally in between the moonpools 5, 6.

The vertical tower 20 has a single vertical operative face 21, e.g. in contrast to the dual operative faces tower illustrated in U.S. Pat. No. 6,763,898.

The tower 20 is provided with a hoisting device comprising at least one winch 30 and at least one winch driven cable 31. The hoisting device is adapted to suspend a load from the vertical tower 20 via the at least one winch driven cable 31 and to manipulate this suspended load in a firing line 25 of the tower 20 that extends along and outside of the vertical operative face 21 of the tower 20.

In more detail the tower 20 has at a top end thereof a cantilevered tower part 24 carrying a crown block assembly 26 with one or more cable sheaves 33 for the cable(s) 31. In this example the cable 31 extends in a multiple falls arrangement between the assembly 26 and the travelling device 50.

The depicted tower 20 has a square cross-section, yet other cross-sections, e.g. rectangular, hexagonal, oval, circular, etc. are also envisaged.

The tower 20 may be embodied as a lattice structure, e.g. with vertical leg members and with diagonal and/or horizontal brace members, e.g. forming side walls of a further substantially hollow tower.

The tower 20 may comprise one or more floors at various heights, as well as stairs leading to said floors.

The vertical tower 20 is connected to the tower supporting hull structure 10 via one or more slew bearings 41, 42. Furthermore the vessel is provided with a slewing drive, here with slewing drive motors 43, 44 driving pinions that engage on a toothed ring of the tower 20.

The vertical tower 20 thus is slewable about a vertical slew axis 27 by means of the slewing drive 43, 44.

Figure 3:
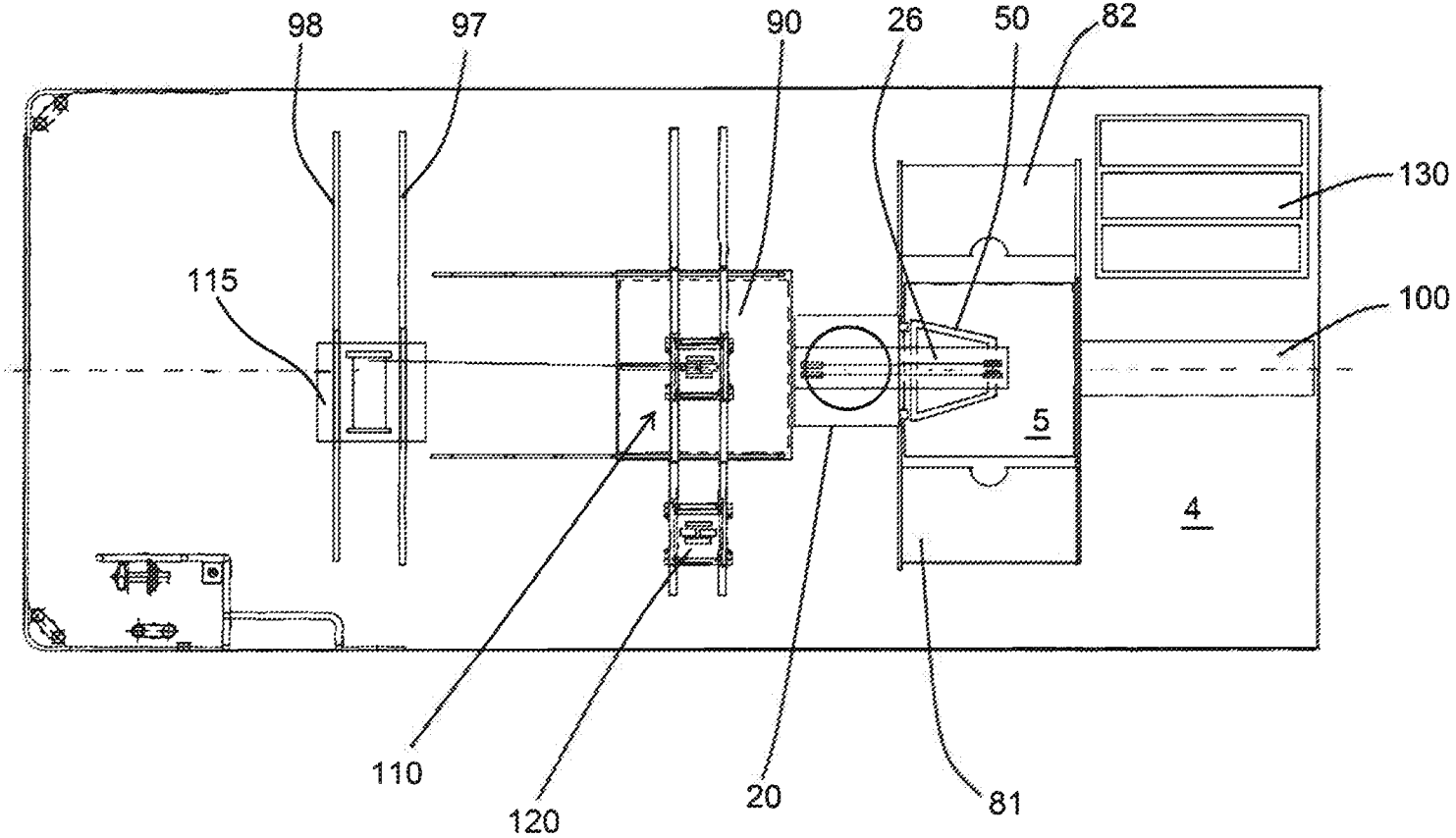
FIG. 3 shows schematically in plan view the deck, moonpool openings and tower of the vessel of FIG. 1 with the tower in the first operative position thereof.

FIG. 3 depicts the situation that the tower 20 is in its first operative position wherein the firing line 25 of the tower 20 extends through the first moonpool area 5.

Figure 2:
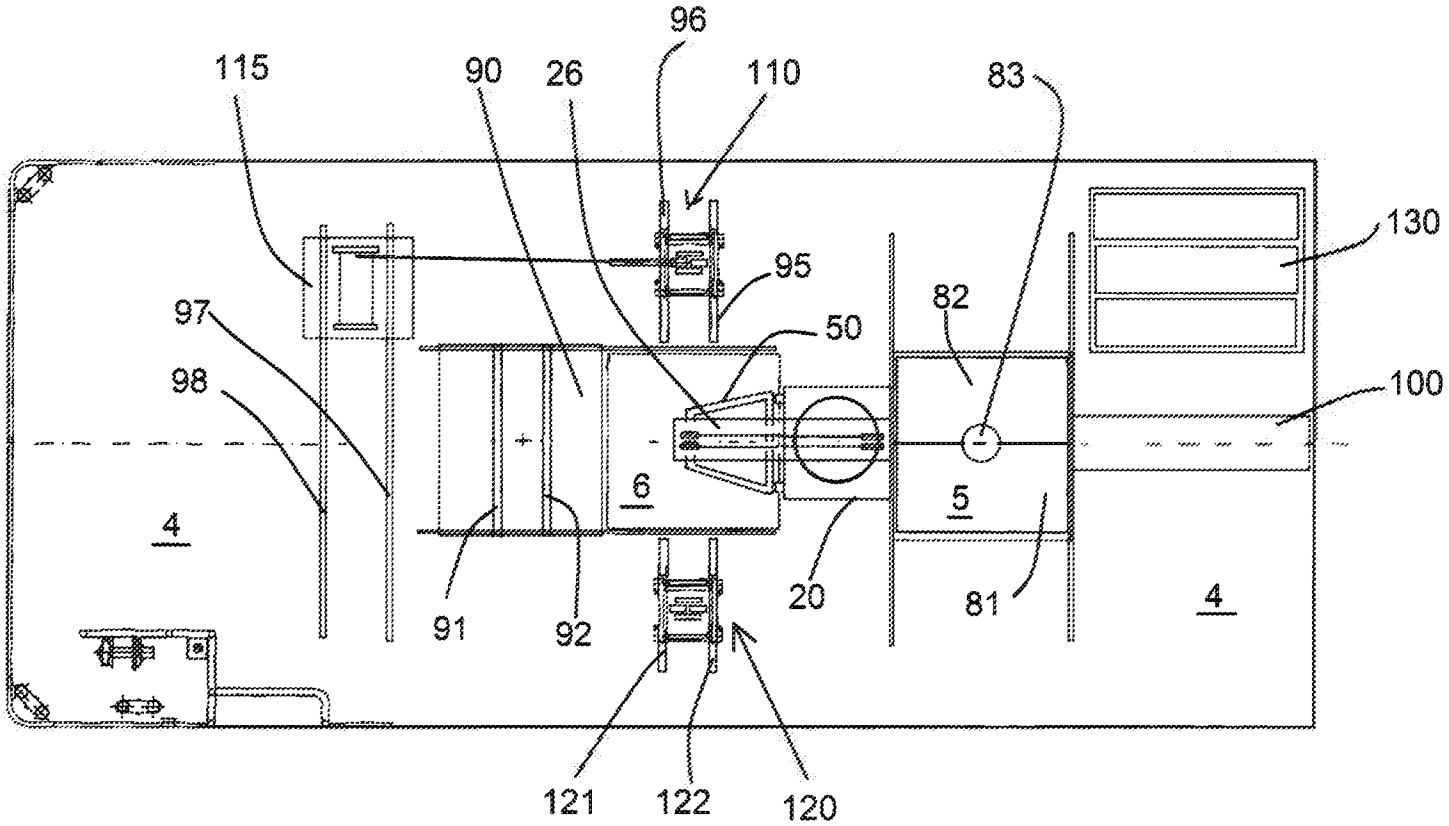
FIG. 2 shows schematically in plan view the deck, moonpool openings and tower of the vessel of FIG. 1 with the tower in the second operative position thereof.

FIG. 2 depicts the situation that the tower 20 is in its second operative position wherein the firing line 25 of the tower 20 extends through the second moonpool area 6.

As will be appreciated, in the depicted embodiment, 2 the first and second operative positions of the tower 20 are diametrically opposite the slew axis 27.

As depicted here the tower has a foot 28 and the at least one slew bearing 41, 42 is arranged between the foot 28 of the tower and the tower supporting hull structure 10.

As shown here the tower is provided at said operative side with vertical guide rails 15.

A travelling device 50, e.g. adapted to support a top drive device 60, is provided. The device 50 is movable up and down along and outside of the operative side 21 of the tower 20 and guided by the vertical guide rails 15 of said tower. In this example the travelling device 50 is suspended from the winch driven cable 31. The travelling device is adapted to suspend a load from the travelling device, e.g. a drilling tubulars string (drill pipe, casing) suspended from or at least attached to the top drive device 60.

Figure 4:
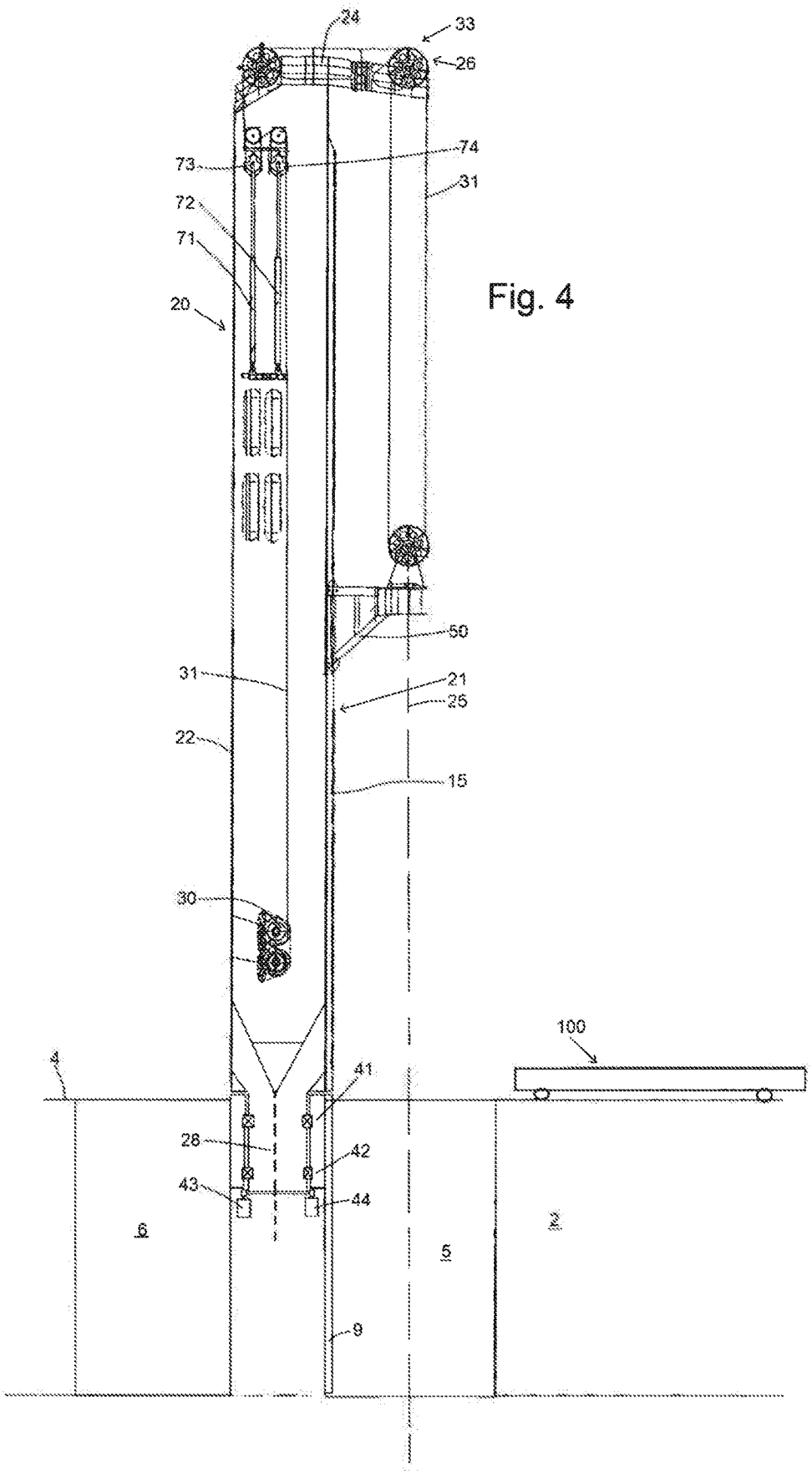
FIG. 4 shows schematically the tower, hull and moonpools of the vessel of FIG. 1.

As can be seen in FIG. 4 the hull of the vessel is provided, here for the first moonpool area 5, with one or more hull mounted vertical guide rails 9 which are arranged such that in the first operative position of the tower 20 these guide rails 15 of the tower 20 align with the one or more hull mounted vertical guide rails 9. As shown here the one or more hull mounted guide rails 9 extend to a lower opening in a bottom of the hull.

In the depicted example the winch 30 is mounted inside the closed wall contour of the tower. As explained the winch(es) 30 can also be mounted on the rear or non-operative side 22 of the tower that is opposite the operative side.

It is depicted that the tower is provided with one or more heave compensation cylinders 71, 72 acting on one or more cable sheaves 73, 74 along with the winch driven cable 31 passes in order to provide heave compensation functionality.

The figures also illustrate that for each of the first and second moonpool areas 5, one or more movable, e.g. horizontally slidable, hatches 81, 82, 90 are provided. These hatches, in an opened position thereof, clear the moonpool opening and in a closed position thereof form a hatch cover over the moonpool opening 5, 6.

Here, the moonpool opening 5 is covered by two hatches 81, 82 that slide horizontally away and towards one another to open and close the opening 5. The mating hatch edges have a cut-out to form a well center opening 83 aligned with the firing line 25 of the tower 20 in its first position. The hatches may be embodied and used as drill floor for drilling operations.

Adjacent the first second moonpool area 5 a catwalk machine 100 is arranged on the deck 4 allowing to feed and remove drilling tubulars to and from the firing line 25 when the tower is in the first operative position thereof associated with the moonpool area 5.

Tubulars storage racks or other storage devices 130 are arranged adjacent the catwalk machine 100.

The hatch 90 associated with the second moonpool opening 6*a* is provided with a pair of skid rails 91, 92 thereon. The deck 4, in a region adjacent the moonpool opening 6*a*, is provided with a pair of deck mounted skid rails 95, 96. In the closed position of hatch 90, see FIG. 3, the pair of skid rails 91, 92 provided thereon align with the pair of deck mounted skid rails 95, 96 in order to allow skidding of an object onto and off the one or more closed position hatches. For example, the object is coiled tubing injector device 110.

The vessel has, here aft of the moonpool 6, on the deck 4 a pair of skid rails 97, 98 on which a skiddable coiled tubing reel 115 is placed.

Not depicted here is an embodiment wherein the vessel is provided with a storage reel storing or configured to store thereon a coiled tubing guide hose, e.g. a composite coiled tubing guide hose. The vessel 1 may be provided with a coiled tubing guide hose tensioner device 120 having multiple tracks 121, 122 in a substantially vertical arrangement. As will be appreciated the tensioner device 120 is configured to be arranged in an operative position thereof above second moonpool area 6 and to support the length of coiled tubing guide hose extending into the sea to subsea equipment mounted on a subsea well head.

The invention claimed is:

1. A vessel adapted to perform subsea wellbore related operations, said vessel comprising:

a floating hull comprising a tower supporting hull structure;

at least one moonpool in said hull defining at least a first moonpool area;

a vertical tower configured to perform subsea wellbore related operations, the vertical tower being mounted on said tower supporting hull structure, said vertical tower having a vertical operative face; and a hoisting device comprising at least one winch and at least one winch driven cable, the hoisting device being adapted to suspend a load from said vertical tower via said at least one winch driven cable and to manipulate said suspended load in a firing line of the tower that extends along and outside of said vertical operative face of the tower, wherein the at least one moonpool of the vessel is embodied to further define a second moonpool area that is offset from said first moonpool area, and wherein the vertical tower is connected to the tower supporting hull structure via one or more slew bearings and the vessel is provided with a slewing drive, such that the vertical tower is slewable about a vertical slew axis by means of said slewing drive at least into a first operative position wherein the firing line of the tower extends through the first moonpool area and into a second operative position wherein the firing line of the tower extends through the second moonpool area.

2. The vessel according to claim 1, wherein the first and second operative positions of the tower are diametrically opposite the slew axis.

3. The vessel according to claim 1, wherein said tower supporting hull structure extends in between said first and second moonpool areas.

4. The vessel according to claim 1, wherein said hull is a monohull having a longitudinal axis, and wherein said first and second moonpool areas are offset in the direction of said longitudinal axis, wherein said tower supporting hull structure extends substantially in transverse direction of the hull and in between said first and second moonpool areas.

5. The vessel according to claim 1, wherein the vessel has a deck and wherein the first and second moonpool areas are defined by offset first and second moonpool openings in the deck.

6. The vessel according to claim 1, wherein the vessel has distinct first and second moonpools, each extending between a respective first and second moonpool opening in a deck of the vessel to a respective lower opening in a bottom of the hull.

7. The vessel according to claim 1, wherein the vessel has a single moonpool with the tower supporting hull structure being embodied as a bridge over a central area of the moonpool, said bridge above the design waterline of the vessel, wherein the first and second moonpool areas are located an opposite sides of the tower supporting hull structure and each defined by a respective first and second moonpool opening in a deck of the vessel.

8. The vessel according to claim 1, wherein the tower has a foot, and wherein at least one slew bearing is arranged between said foot of the tower and the tower supporting hull structure.

9. The vessel according to claim 1, wherein the tower is provided at said operative side with one or more vertical guide rails, and wherein a travelling device is provided that is movable up and down along and outside of said operative side of the tower and guided by said one or more vertical guide rails of said tower, wherein said travelling device is suspended from said winch driven cable, and wherein the travelling device is adapted to suspend a load from said travelling device, and wherein the hull of the vessel is provided, at least for one of the first and the second moonpool areas, with one or more hull mounted vertical guide rails which are arranged such that in at least one of said first and said second operative position of the tower, said guide rails of the tower align with said one or more hull mounted vertical guide rails.

10. The vessel according to claim 1, wherein the winch is mounted on the tower, and wherein the tower is provided with one or more heave compensation cylinders acting on one or more cable sheaves along which the winch driven cable passes in order to provide heave compensation functionality.

11. The vessel according to claim 1, where a top drive device is connected to the travelling device.

12. The vessel according to claim 1, wherein at least one of said first and second moonpool areas is defined by a moonpool opening in a deck of the vessel, and wherein the vessel is provided with one or more movable hatches associated with said moonpool opening, said one or more hatches in an opened position thereof clearing the moonpool opening and in a closed position thereof forming a hatch cover over the moonpool opening.

13. The vessel according to claim 12, wherein the one or more hatches associated with at least one of said first and second moonpool opening are provided with a pair of skid rails, and wherein the deck in a region adjacent the moonpool opening is provided with a pair of deck mounted skid rails, wherein, in said closed position of said one or more hatches the pair of skid rails provided thereon align with the pair of deck mounted skid rails in order to allow skidding of an object onto and off the one or more closed position hatches, and wherein the vessel is provided with a coiled tubing injector device, said coiled tubing injector device being adapted for skidding onto and off the one or more closed position hatches.

14. The vessel according to claim 13, wherein the vessel has a deck adjacent at least one of the first and second moonpool areas, and wherein a pair of skid rails are provided on which a skiddable coiled tubing reel is placed.

15. The vessel according to claim 1, wherein the vessel has deck adjacent one of the first and the second moonpool areas, and wherein a catwalk machine is arranged on said deck allowing to feed and remove drilling tubulars to and from the firing line when the tower is in the operative position thereof associated with said moonpool area.

16. The vessel according to claim 1, wherein the vessel is provided with a storage reel storing thereon a spoolable coiled tubing guide hose, and wherein the vessel is provided with a coiled tubing guide hose tensioner device having multiple tracks in a substantially vertical arrangement, which tensioner device is configured to be arranged in an operative position thereof above said first or said second moonpool area and to support the length of spoolable coiled tubing guide hose extending into the sea to subsea equipment mounted on a subsea well head.

17. A vessel adapted to perform subsea wellbore related operations, said vessel comprising:

a floating monohull having a longitudinal axis, the floating hull comprising a tower supporting hull structure;

at least one moonpool in said hull defining at least a first moonpool area;

a vertical tower configured to perform subsea wellbore related operations, the vertical tower being mounted on said tower supporting hull structure, said vertical tower having a vertical operative face; and a hoisting device comprising at least one winch and at least one winch driven cable, the hoisting device being adapted to suspend a load from said vertical tower via said at least one winch driven cable and to manipulate said suspended load in a firing line of the tower that extends along and outside of said vertical operative face of the tower, wherein the at least one moonpool of the vessel is embodied to further define a second moonpool area that is offset from said first moonpool area in direction of said longitudinal axis, wherein the vessel has a deck, and wherein the first and second moonpool areas are defined by offset first and second moonpool openings in the deck, wherein said tower supporting hull structure extends substantially in transverse direction of the hull and in between said first and second moonpool areas, and wherein the vertical tower is connected to the tower supporting hull structure via one or more slew bearings and the vessel is provided with a slewing drive, such that the vertical tower is slewable about a vertical slew axis by means of said slewing drive at least into a first operative position wherein the firing line of the tower extends through the first moonpool area and into a second operative position wherein the firing line of the tower extends through the second moonpool area.

18. The vessel according to claim 17, wherein the vessel has a single moonpool with the tower supporting hull structure being embodied as a bridge over a central area of the moonpool, said bridge above a design waterline of the vessel, wherein the first and second moonpool areas are located an opposite sides of the tower supporting hull structure, wherein the tower has a foot, and wherein at least one slew bearing is arranged between said foot of the tower and the tower supporting hull structure.

19. The vessel according to claim 17, wherein the tower is provided at said operative side with one or more vertical guide rails, and wherein a travelling device is provided that is movable up and down along and outside of said operative side of the tower and guided by said one or more vertical guide rails of said tower, wherein said travelling device is suspended from said winch driven cable, and wherein the travelling device is adapted to suspend a load from said travelling device, and wherein the hull of the vessel is provided, at least for one of the first and the second moonpool areas, with one or more hull mounted vertical guide rails which are arranged such that in at least one of said first and/or said second operative position of the tower said guide rails of the tower align with said one or more hull mounted vertical guide rails.

20. A vessel adapted to perform subsea wellbore related operations, said vessel comprising:

a floating hull comprising a tower supporting hull structure;

at least one moonpool in said hull defining at least a first moonpool area;

a vertical tower configured to perform subsea wellbore related operations, the vertical tower being mounted on said tower supporting hull structure, said vertical tower having a vertical operative face; and a hoisting device comprising at least one winch and at least one winch driven cable, the hoisting device being adapted to suspend a load from said vertical tower via said at least one winch driven cable and to manipulate said suspended load in a firing line of the tower that extends along and outside of said vertical operative face of the tower, wherein the at least one moonpool of the vessel is embodied to further define a second moonpool area that is offset from said first moonpool area, wherein the vertical tower is connected to the tower supporting hull structure via one or more slew bearings and the vessel is provided with a slewing drive, such that the vertical tower is slewable about a vertical slew axis by means of said slewing drive at least into a first operative position wherein the firing line of the tower extends through the first moonpool area and into a second operative position wherein the firing line of the tower extends through the second moonpool area, wherein at least one of said first and second moonpool area is defined by a moonpool opening in a deck of the vessel, and wherein the vessel is provided with one or more movable hatches associated with said moonpool opening, said one or more hatches in an opened position thereof clearing the moonpool opening and in a closed position thereof forming a hatch cover over the moonpool opening, wherein the one or more hatches are provided with a pair of skid rails, and wherein the deck in a region adjacent the moonpool opening is provided with a pair of deck mounted skid rails, wherein, in said closed position of said one or more hatches the pair of skid rails provided on said one or more hatches align with the pair of deck mounted skid rails in order to allow skidding of an object onto and off the one or more closed position hatches, wherein the vessel is provided with a coiled tubing injector device adapted for skidding over said pairs of skid rails onto and off the one or more closed position hatches, and wherein a further pair of skid rails is provided on said deck, on which a skiddable coiled tubing reel is placed.

21. The vessel according to claim 20, wherein the vessel is provided with a storage reel storing thereon a spoolable coiled tubing guide hose, and wherein the vessel is provided with a coiled tubing guide hose tensioner device having multiple tracks in a substantially vertical arrangement, which tensioner device is configured to be arranged in an operative position thereof above said first or said second moonpool area and to support the length of spoolable coiled tubing guide hose extending into the sea to subsea equipment mounted on a subsea well head.

* * * * *